United States Patent [19]

Fukuda

[11] Patent Number: 4,574,913

[45] Date of Patent: Mar. 11, 1986

[54] MUFFLER WITH SPARK ARRESTING FUNCTION

[75] Inventor: Masuo Fukuda, Omiya, Japan

[73] Assignee: Sankei Giken Kogyo Kabushiki Kaisha, Tokyo, Japan

[21] Appl. No.: 664,349

[22] Filed: Oct. 24, 1984

[30] Foreign Application Priority Data

Nov. 11, 1983 [JP] Japan ..... 58-175016[U]
Nov. 11, 1983 [JP] Japan ..... 58-175017[U]

[51] Int. Cl.[4] ..... F01N 3/02

[52] U.S. Cl. ..... 181/231; 181/256; 181/265; 181/272; 181/280

[58] Field of Search ..... 181/231, 244, 248–258, 181/264, 265, 268, 272, 275, 280; 55/276, DIG. 20

[56] References Cited

U.S. PATENT DOCUMENTS

| | | | |
|---|---|---|---|
| 2,834,426 | 5/1958 | Mason | 181/269 |
| 2,942,683 | 6/1960 | Moyer | 55/276 |
| 3,545,565 | 12/1970 | McCaffrey, Jr. | 181/264 X |
| 3,679,024 | 7/1972 | Kirkland, Jr. et al. | 181/273 |
| 4,056,934 | 11/1977 | Mizusawa et al. | 181/264 X |
| 4,192,402 | 3/1980 | Nakagawa et al. | 181/272 X |
| 4,235,304 | 11/1980 | Suyama | 181/265 |
| 4,317,502 | 3/1982 | Harris et al. | 181/280 |

*Primary Examiner*—Benjamin R. Fuller
*Attorney, Agent, or Firm*—Birch, Stewart, Kolasch & Birch

[57] ABSTRACT

A muffler for use with various instruments and furnished with a spark arresting function. An inlet pipe for receiving exhaust gases from the instrument and an outlet pipe for discharging the exhaust gases to the atmosphere are arranged in an expansion chamber of a housing with their one end open to the latter. The expansion chamber is divided into two compartments by a partition having a wire net therewith. An intermediate pipe for providing fluid communication between the two compartments is mounted on the partition. The air flow area of the wire net and the cross-sectional area of the intermediate pipe are selected such that the quantity of the gases flowing through the wire net is larger than that of the gases flowing through the intermediate pipe. The outlet pipe is formed with an exhaust gas inlet through its side wall portion which is larger in area than the open one end and covered with a wire net. The inlet and outlet pipes are formed respectively with a plurality of exhaust gas outlet apertures and a plurality of exhaust gas inlet apertures adjacent to their nearby ends.

25 Claims, 15 Drawing Figures

MUFFLER WITH SPARK ARRESTING FUNCTION

BACKGROUND OF THE INVENTION

1. Field of the Invention

The present invention relates to an improved muffler having a function of arresting sparks which are apt to develop in exhaust systems of various internal combustion engines as well as in generators and often constitute a cause of fires.

2. Description of the Prior Art

An exhaust system of an internal combustion engine or a generator ordinarily used today tends to produce undesired sparks which lead to fires. So-called spark arresters or mufflers with a spark arresting function, therefore, need be used for fire protection particularly with motorcycles operated in the field, general-purpose engines and engine generators which are movable to any desired site for operation, lown mowers, tank trucks for transporting combustibles, dust collectors associated with buffing machines, etc. In many countries, furnishing such an instrument with a spark arrester or a muffler with a similar function to a spark arrester is a legal obligation and a minimum standard which such a spark arrester or muffler should clear for prevention of fires is established; the use of spark arresters which are short of the standard is inhibited.

In light of the above situation, various types of spark arresters and mufflers have heretofore been proposed. For example, U.S. Pat. No. 3,407,575 (Krizman) discloses a spark arrester which is constructed to whirl entering gases so that an outer shell of a double tube having a closed end may trap sparks, or carbon particles. Although the disclosed spark arrester may effectively arrest exhaust sparks, it creates another problem that turbulence tends to develop in the flow of the gases constituting a source of noise and, therefore, a muffler has to be backed up by the spark arrester.

Another known spark arrester is furnished with a netting in the form of a sack which is fixed to the outlet of a muffler or either one of opposite ends of an inlet pipe. Such an implementation, however, requires periodic cleaning because the netting tends to be stopped up to increase the back pressure and, thereby, deteriorate the engine performance.

SUMMARY OF THE INVENTION

It is therefore an object of the present invention to provide an improved muffler for an internal combustion engine or a generator each having a spark arresting function.

It is another object of the present invention to provide a muffler with a spark arresting function which is operable without increasing the back pressure of an engine.

It is another object of the present invention to provide a muffler with a spark arresting function which eliminates the need for frequent cleaning and promotes the ease of maintenance.

It is another object of the present invention to provide a muffler with a spark arresting function which may be economically constructed and assembled.

In one aspect of the present invention, there is provided a muffler having a function of arresting sparks, or carbon particles, which are contained in exhaust gases emanating from an instrument, comprising a generally tubular housing having an expansion chamber therein, an inlet pipe having an exhaust gas inlet communicating to the instrument and an exhaust gas outlet open to the expansion chamber, an outlet pipe having an exhaust gas outlet open to the atmosphere and an exhaust gas inlet open to the expansion chamber for admitting the exhaust gases into the outlet pipe, a partition member for dividing the expansion chamber into at least a first compartment and a second compartment, a meshed member associated with the partition for communicating the exhaust gases from the first compartment to the second compartment, and an intermediate pipe mounted on the partition member for providing fluid communication between the first and second compartments, the intermediate pipe having an exhaust gas inlet open to the first compartment.

In another aspect of the present invention, there is provided a muffler having a function of arresting sparks, or carbon particles, which are contained in exhaust gases emanating from an instrument, comprising a generally tubular housing having an expansion chamber therein, an inlet pipe having an exhaust gas inlet communicating to the instrument and an exhaust as outlet open to the expansion chamber, an output pipe having an exhaust gas outlet open to the atmosphere, a first exhaust gases into the outlet pipe, and a second exhaust gas inlet having an area larger than an area of the first exhaust gas inlet, and a meshed member for covering the second exhaust gas inlet.

In accordance with the present invention, a muffler for use with various instruments and furnished with a spark arresting function includes an inlet pipe for receiving exhaust gases from the instrument and an outlet pipe for discharging the exhaust gases to the atmosphere, which are arranged in an expansion chamber of a housing with their one end open to the latter. The expansion chamber is divided into two compartments by a partition having a wire net therewith. An intermediate pipe for providing fluid communication between the two compartments is mounted on the partition. The air flow area of the wire net and the cross-sectional area of the intermediate pipe are selected such that the quantity of the gases flowing through the wire net is larger than that of the gases flowing through the intermediate pipe. The outlet pipe is formed with an exhaust gas inlet through its side wall portion which is larger in area than the open one end. The inlet and outlet pipes are formed respectively with a plurality of exhaust gas outlet apertures and a plurality of exhaust gas inlet apertures adjacent to their nearby ends.

BRIEF DESCRIPTION OF THE DRAWINGS

The objects and features of the present invention will become more apparent from a consideration of the following detailed description taken in conjunction with the accompanying drawings in which.

DESCRIPTION OF THE PREFERRED EMBODIMENTS

An embodiment of the muffler with a spark arresting function of the present invention and modifications thereto will be described in detail with reference to the accompanying drawings.

Figure 1:
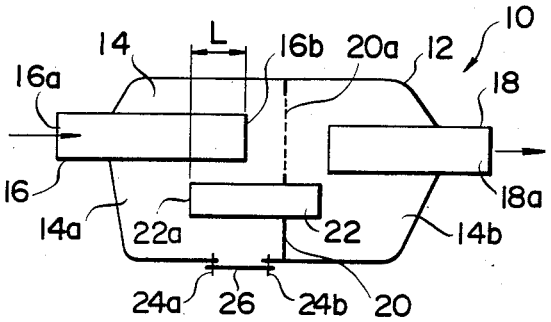
FIG. 1 is a vertical section of a muffler with a spark arresting function embodying the present invention.

Referring to FIG. 1, a muffler with a spark arresting function embodying the present invention is shown and generally designated by the reference numeral 10. The muffler 10 comprises a tubular or box-like housing 12 which has an expansion chamber 14 therein. An inlet pipe 16 having an inlet 16*a* and an outlet 18 having an outlet 18*a* are welded or otherwise fixed to the housing 12 such that each of them is partly disposed in the expansion chamber 14. Exhaust gases emanating from an exhaust system of an internal combustion engine or the like (not shown) enters the expansion chamber 14 via the inlet 16*a* and leaves it from the outlet 18*a*, as will be described. A partition 20 divides the expansion chamber 14 into first and second compartments 14*a* and 14*b*; part of the inlet pipe 16 is located in the first compartment 14*a*, and part of the outlet pipe 18 in the second compartment 14*b*. If desired, two or more partitions may be used to define three or more such compartments. The compartments 14*a* and 14*b* are communicated to each other by a pipe 22 which is securely supported by the partition 20. The inlet pipe 16 and the pipe, or intermediate pipe, 22 overlap each other over a length L so that their adjacent ends, i.e., outlet 16*b* and inlet 22*a*, do not align with each other. Such a relative position between the pipes 16 and 22 is to prevent sparks, or carbon particles, entrained by the gaseous stream from being admitted into the intermediate pipe 22. The intermediate pipe 22 is smaller in diameter than the inlet pipe 16. Part 20*a* of the partition 20 which faces the outlet 16*b* of the inlet pipe 16 comprises a meshwork. The total air flow area of the meshed part 20*a* of the plate 20 is selected to be larger than the sectional-area of the intermediate pipe 22. Preferably, the meshwork comprises stainless steel wires having a mesh number larger than 30 and a diameter on the order of 0.3 millimeter which sufficiently intercept carbon particles. Specifically, a mesh number 20 successfully intercepts carbon particles by 70%, and a mesh number 30 by 30%.

In the construction described above, exhaust gases admitted into the first compartment 14*a* via the inlet pipe 16 impinge on the meshed part 20*a* of the partition 20, so that sparks contained in the gases are intercepted by the mesh to drop by gravity and, thereby, accmulate on the bottom of the first compartment 14*a*. Therefore, hardly any spark is contained in the gases which enter the second compartment 14*b* via the meshed part 20*a* or the gases which are routed by way of the intermediate pipe 22 to the compartment 14*b*. Since the gases coming in through the inlet pipe 16 continuously rush onto the meshed part 20*a*, the sparks are blown off the meshed part 20*a* without being deposited thereon. Some clogging, if occurred, would not contribute to the rise of the back pressure of the engine due to the flow through the intermediate pipe 22. A lid 26 is detachably mounted to the bottom of the first compartment 14*a* by means of bolts 24*a* and 24*b*. When the lid 26 is removed, the carbon particles deposited on the bottom of the first compartment 14*a* will be readily blown off to the outside by the incoming exhaust gases.

As described above, the muffler in accordance with the this particular embodiment attains a muffling function and a spark arresting function at the same time.

Various modifications to the embodiment shown in FIG. 1 will hereinafter be described in detail. In the modifications, the same or similar structural elements as those shown in FIG. 1 are designated by like reference numerals.

Figure 2:
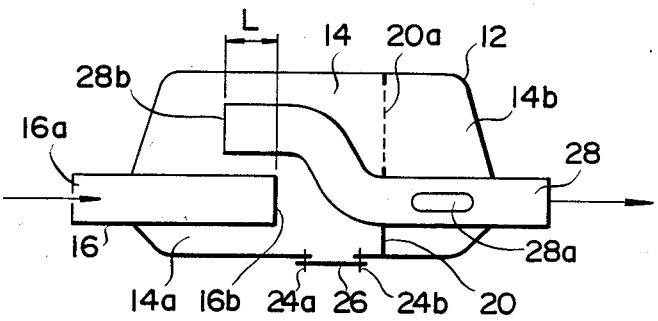
FIGS. 2–15 are views similar to FIG. 1 but showing various modifications to the embodiment of FIG. 1.

In a modification shown in FIG. 2, the muffler with a spark arresting function includes an outlet pipe 28 which extends throughout the partition 20 into the first compartment 14*a*. The outlet pipe 28 is formed with an opening 28*a* through its side wall portion inside the second compartment 14*b*, so that the exhaust gases flown through the meshed part 20*a* of the partition 20 are routed into the outlet pipe 28 via the opening 28*a* and, therefrom, to the atmosphere. The outlet pipe 28, therefore, serves as both the outlet pipe 18 and the intermediate pipe 22 shown in FIG. 1. The nearby end portions of the pipes 16 and 28 overlap each other over a length L so that an inlet 28*b* of the pipe 28 may not be aligned with the outlet 16*b* of the pipe 16.

Figure 3:
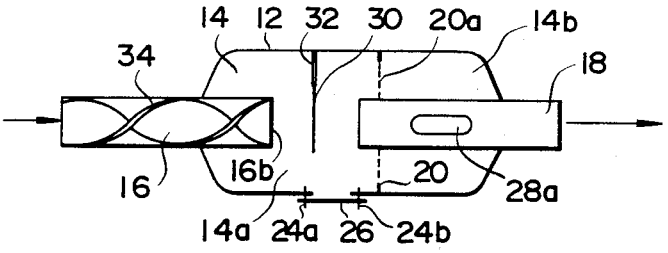

A modification shown in FIG. 3 is constructed in such a manner as to make the expansion chamber 14 small size. Specifically, the inlet pipe 16 and the outlet pipe 18 are coaxially aligned with each other in the intended direction of flow. The outlet pipe 18 extends throughout the meshed part 20*a* of the partition 20, or the partition 20 itself, into the first compartment 14*a*. Further, in order that the exhaust gases flowing out from the inlet pipe 16 may be prevented from directly entering the outlet pipe 18, a plate 30 for baffling the gases is disposed in the first compartment 14*a* to intervene between the facing ends of the pipes 16 and 18 and is supported by an arm 32. In this particular modification, a whirling motion may be applied to the gaseous stream coming out from the inlet pipe 16 so as to separate the sparks from the gases toward the periphery of the expansion chamber 14. This is generally effective when the inside diameter of the expansion chamber is relatively small. The whirling motion may be implemented by a screw member 34 which is disposed in the inlet pipe 16 as illustrated in FIG. 3.

Figure 4:
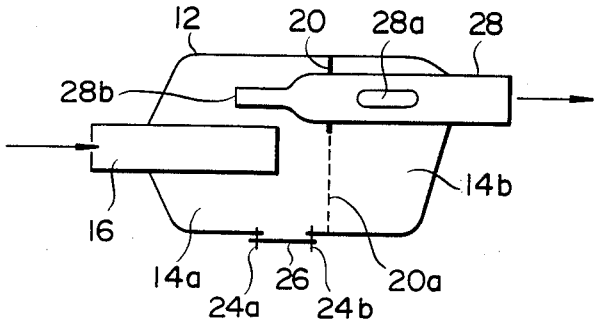

A modification shown in FIG. 4 is similar to that of FIG. 2. The difference is that in FIG. 4 a portion of the outlet pipe 28 adjacent to the inlet 28*b* has a reduced diameter in order to suppress communication of the spark-containing gases from the inlet pipe 16 to the outlet pipe 28.

Figure 5:
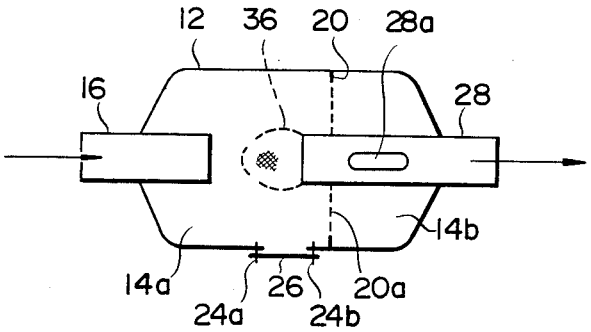
Figure 6:
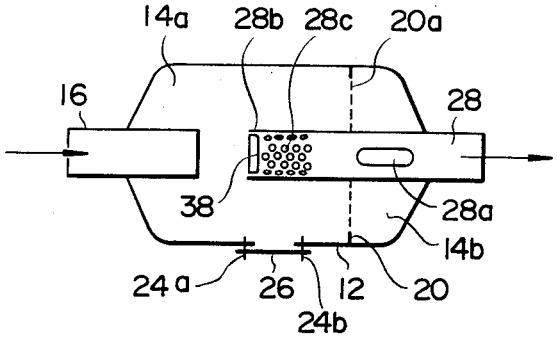

FIG. 5 shows a modification in which a meshed cap 36 covers the open end 28*b* of the outlet pipe 28 which extends into the first compartment 14*a*. FIG. 6 shows a modification in which the outlet pipe 28 is stopped at its open end 28*b* by a plug 38 and, instead, formed with apertures 28*c* through its wall adjacent to the plugged end 28*b* for communication with the first compartment 14*a*.

Figure 7:
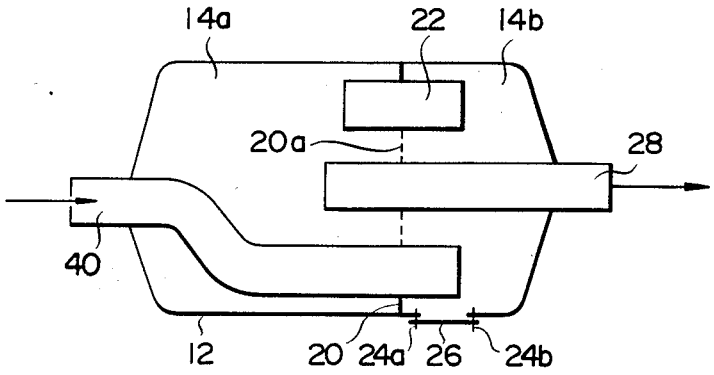
Figure 8:
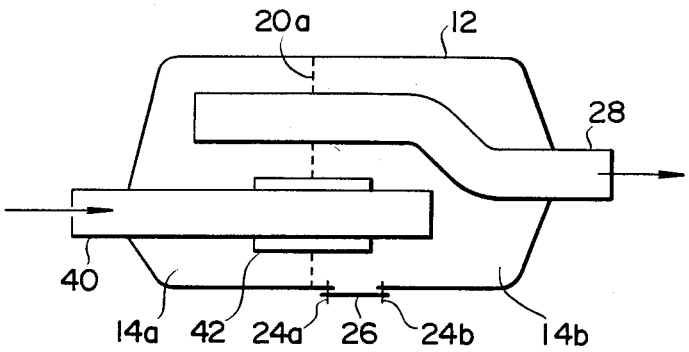

In a modification shown in FIG. 7, an inlet pipe 40 extends through the partition 20 so that the relationship between the first and second compartments 14*a* and 14*b* is inverse to that of the foregoing modifications. A modification shown in FIG. 8 includes an intermediate pipe 42 which is a modified version of the pipe 22 of FIG. 7 and has a larger diameter than the inlet pipe 40, the pipe 42 being concentrically coupled over the inlet pipe 40.

Modifications shown in FIGS. 9–15 commonly lack the partition 20 with the meshed part 20*a* which is shown in any of FIGS. 1–8 and, instead, includes a wire net 44 which covers an opening 28*a* of the outlet pipe 28.

Figure 9:
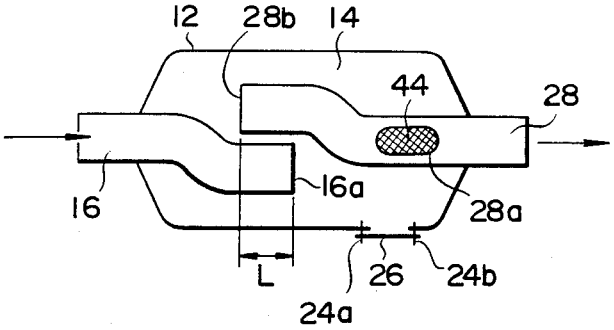
Figure 10:
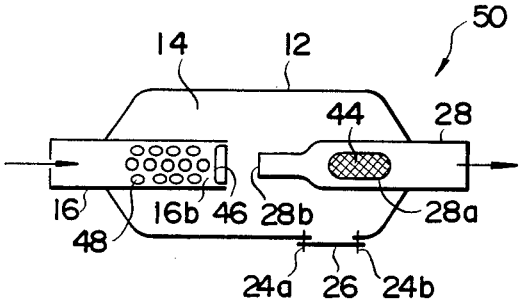

In the modification shown in FIG. 9, the outlet 16*a* of the inlet pipe 16 and the inlet 28*b* of the outlet pipe 28 are dislocated by a length L from each other in the intended direction of flow. In the modification shown in FIG. 10, the outlet 16*b* of the inlet pipe 16 is closed by a plug 46 and, instead, the wall of the pipe 16 is formed with numerous apertures 48 adjacent to the outlet 16*b* for communicating the gases in the pipe 16 to the expansion chamber 14. Further, the outlet pipe 28 in FIG. 10 is somewhat reduced in diameter adjacent to the open end 28*b*.

Figure 11:
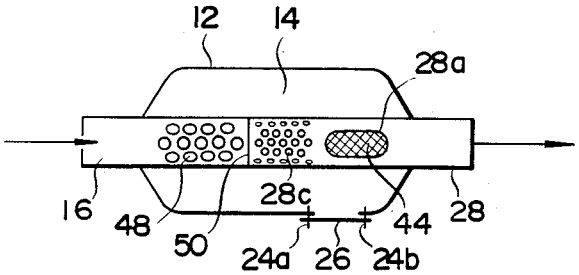

In a modification shown in FIG. 11, the inlet pipe 16 and the outlet pipe 28 are connected integrally and serially with each other along the direction of flow but prevented from fluidly communicating to each other by a partition 50. The end portions of the pipes 16 and 28 adjacent to the partition 50 are formed respectively with apertures, or outlets, 48, and the apertures, or inlets, 28*c*. A modification shown in FIG. 12 includes a meshed cap 52 which covers the inlet 28*b* of the outlet pipe 28. A modification shown in FIG. 13 includes a plug 54 which stops the inlet 28*b* of the outlet pipe 28, which is in turn formed with the inlet apertures 28*c* adjacent to the inlet 28*b*.

Figure 14:
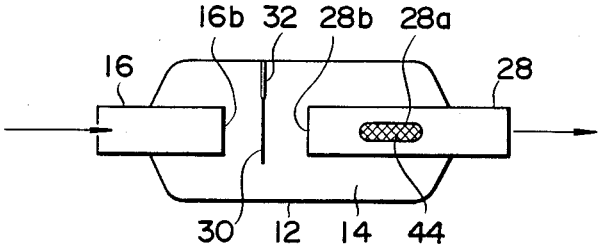
Figure 15:
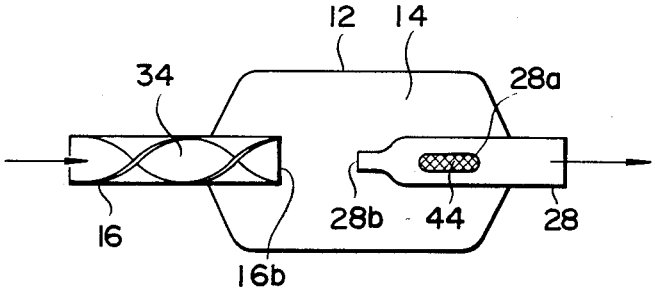

In a modification shown in FIG. 14, the baffling plate 30 is located between the nearby open ends 16*b* and 28*b* of the inlet and outlet pipes 16 and 28 inside the expansion chamber 14 and supported by the arm 32. In a modification shown in FIG. 15, the gases propagating through the inlet pipe 16 are caused to whirl by the screw member 34 disposed in the inlet pipe 16 and, as a result, sparks are separated by centrifugal force toward the inner wall of the expansion chamber 14 when the gases dash in from the inlet pipe 16.

Figure 12:
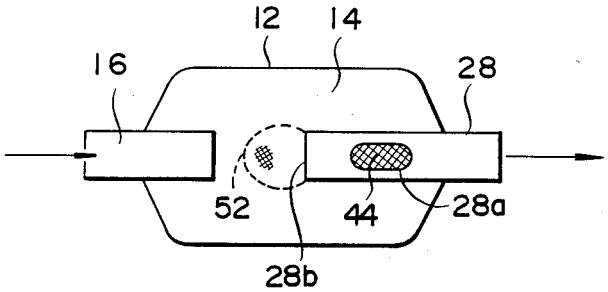
Figure 13:
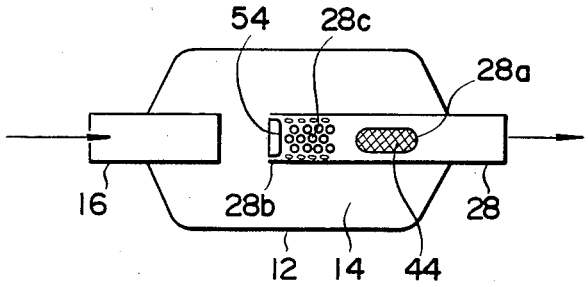

In the modifications shown in FIGS. 9–15, the opening 28*a* of the outlet pipe 28 is provided with an area which is calibrated to be larger than the area of the other inlet 28*b*, the total area of the apertures 28*c*, or the total air flow area of the meshed cap 52 (FIG. 12). Therefore, after the gases propagating through the inlet pipe 16 have been expanded in expansion chamber 14, their major flow into the outlet pipe 28 occurs by way of the opening 28*a* which is covered by the wire net 44.

In these modifications, sparks entrained by the gases are partly separated while the gases undergo diffusion in the expansion chamber 14 or intercepted by the wire net 44 and, hence, they are prevented from entering the outlet pipe 28. Further, even the sparks tending to stick to the wire net 44 are blown off by the gaseous stream, thereby substantially eliminating clogging of the wire net 44. Some clogging if occurred would not increase the back pressure of the engine because the gases are communicated to the interior of the pipe 28 via the opening 28*a* and the apertures 28*c*. Experiments showed that where the wire net 44 comprises wires made of stainless steel having a mesh number larger than 30 and a diameter on the order of 0.3 millimeter, it is capable of sufficiently blocking sparks, or carbon particles. Particularly, a mesh number 20 intercepts carbon particles by 70% and a mesh number 30 by 30%.

In summary, it will be seen that the present invention provides a muffler which has a spark arresting function as well as a muffling function and, in addition, has a simple construction which is feasible for quantity production and easy to maintain.

Various modifications will become possible for those skilled in the art after receiving the teachings of the present disclosure without departing from the scope thereof.

What is claimed is:

1. A muffler having a function of arresting sparks, or carbon particles, which are contained in exhaust gases emanating from an instrument, comprising:

a generally tubular housing having an expansion chamber formed therein;

an inlet pipe having an exhaust gas inlet communicating with said instrument and an exhaust gas outlet open to said expansion chamber;

outlet pipe means having an exhaust gas outlet open to the atmosphere for conducting the exhaust gases from said expansion chamber to the atmosphere, said outlet pipe means having first and second inlets communicating with said expansion chamber;

a meshed member provided at said second inlet for arresting the sparks, or carbon particles, contained in the gases passing therethrough and directed to said second inlet;

said outlet pipe means being so disposed as to prevent said first inlet from receiving directly the exhaust gases which are blown from said exhaust gas outlet of said inlet pipe and do not pass through said meshed member;

said second inlet being disposed to receive the exhaust gases which passed through said meshed member from said exhaust gas outlet of said inlet pipe.

2. A muffler in accordance with claim 1, further comprising means for discharging to the outside said carbon particles which are deposited in the expansion chamber.

3. A muffler in accordance with claim 1, further comprising a partition member for dividing the expansion chamber into first and second compartments;

said exhaust gas outlet of said inlet pipe being open to said first compartment;

said outlet pipe means second inlet being open to the second compartment, and an intermediate pipe mounted on said partition member for providing fluid communication between said first and second compartments, said intermediate pipe having a first inlet formed open to said first compartment.

4. A muffler in accordance with claim 3, wherein said intermediate pipe has a diameter smaller than a diameter of said inlet pipe.

5. A muffler in accordance with claim 3, in which said intermediate pipe has a cross-sectional area smaller than a total air flow area of said meshed member.

6. A muffler in accordance with claim 3, wherein said intermediate pipe has a diameter larger than a diameter of said inlet pipe, said inlet pipe extending throughout and concentrically with said intermediate pipe.

7. A muffler in accordance with claim 3, wherein said intermediate pipe and said outlet pipe means are formed integrally with each other.

8. A muffler in accordance with claim 7, wherein said inlet pipe and said intermediate pipe are arranged coaxially with each other in an intended direction of flow of the exhaust gases, said muffler further comprising a plate intervening between said exhaust gas outlet of said inlet pipe and said first inlet of said intermediate pipe.

9. A muffler in accordance with claim 7, wherein said intermediate pipe has a diameter which is reduced in the vicinity of said first inlet.

10. A muffler in accordance with claim 7 further comprising a meshed cap for covering said first inlet of said intermediate pipe.

11. A muffler in accordance with claim 7, further comprising a plug for stopping said first inlet of said intermediate pipe and a plurality of apertures formed through said intermediate pipe adjacent to said first inlet thereof.

12. A muffler in accordance with claim 3, wherein said inlet and said intermediate pipes overlap each other over a predetermined length in an intended direction of flow of the exhaust gases to maintain said exhaust gas outlet of said pipe and said first inlet of said intermediate pipe out of alignment with each other.

13. A muffler in accordance with claim 1, further comprising a partition member for dividing the expansion chamber into first and second compartments;

said exhaust gas outlet of said inlet pipe being open to said first compartment;

said outlet pipe means first and second inlets being formed open to said first and second compartments.

14. A muffler in accordance with claim 13, wherein said inlet pipe and said outlet pipe means overlap each other over a predetermined length in an intended direction of flow of the exhaust gases to maintain the exhaust gas outlet of said inlet pipe and said exhaust gas inlet of said outlet pipe means out of alignment with each other.

15. A muffler in accordance with claim 1, wherein said outlet pipe means first and second inlets are open to said expansion chamber;

and said meshed member covers the second inlet of said outlet pipe.

16. A muffler in accordance with claim 15, wherein said inlet pipe and said outlet pipe means overlap each other over a predetermined length in an intended direction of exhaust gas flow to maintain said exhaust gas outlet of said inlet pipe and said first inlet of said outlet pipe means out of alignment.

17. A muffler in accordance with claim 15, further comprising a screw member disposed in said inlet pipe.

18. A muffler in accordance with claim 15, wherein said outlet pipe means has a diameter which is reduced in the vicinity of said first inlet thereof.

19. A muffler in accordance with claim 15, further comprising a plug for stopping said exhaust gas outlet of said inlet pipe and a plurality of apertures formed through said inlet pipe adjacent to said exhaust gas outlet thereof.

20. A muffler in accordance with claim 15, further comprising a plug for stopping said first exhaust gas inlet of said outlet pipe means and a plurality of apertures formed through said outlet pipe means adjacent to said first exhaust gas inlet.

21. A muffler in accordance with claim 15, further comprising a meshed cap for covering said first exhaust gas inlet of said outlet pipe means.

22. A muffler in accordance with claim 15, wherein said inlet pipe and said outlet pipe means are arranged coaxially with each other in an intended direction of exhaust gas flow, said muffler further comprising a plate intervening between said exhaust gas outlet of said inlet pipe and said first exhaust gas inlet of said outlet pipe means.

23. A muffler in accordance with claim 15, further comprising a plate for connecting said exhaust gas outlet of said inlet pipe and said first exhaust gas inlet of said outlet pipe means while partitioning said exhaust gas outlet and said first exhaust gas inlet, said inlet pipe being formed with a plurality of apertures adjacent to said exhaust gas outlet thereof while said outlet pipe means being formed with a plurality of apertures adjacent to said first exhaust gas inlet thereof.

24. A muffler in accordance with claim 15, further comprising means for discharging to the outside the carbon particles which are deposited in said expansion chamber.

25. A muffler in accordance with claim 15, wherein said second inlet is larger in area than said first inlet.

* * * * *